US005297725A

United States Patent [19]

Sutherland

[11] Patent Number: 5,297,725

[45] Date of Patent: Mar. 29, 1994

[54] CARRIER FOR STACKED ARTICLES

[75] Inventor: Robert L. Sutherland, Kennesaw, Ga.

[73] Assignee: Riverwood International Corporation, Atlanta, Ga.

[21] Appl. No.: 87,567

[22] Filed: Jul. 1, 1993

[51] Int. Cl.[5] ..... B65D 5/46; B65D 5/54

[52] U.S. Cl. ..... 229/117.13; 229/243; 229/244; 229/920

[58] Field of Search ..... 229/40, 117.13, 240–244, 229/920; 206/427

[56] References Cited

U.S. PATENT DOCUMENTS

| | | | |
|---|---|---|---|
| 2,681,143 | 6/1954 | Guyer | 206/427 |
| 2,797,856 | 7/1957 | Jaeschke | 229/117.13 |
| 2,911,136 | 11/1959 | Stone | 229/117.13 |
| 3,076,591 | 2/1963 | Nute et al. | 229/117.13 |
| 3,904,036 | 9/1975 | Forrer | 206/427 |
| 3,994,432 | 11/1976 | Kirby, Jr. | 206/427 |
| 4,304,332 | 12/1981 | Danti | 206/427 |
| 4,331,289 | 5/1982 | Killy | 206/427 |
| 4,396,143 | 8/1983 | Killy | 206/427 |
| 4,577,799 | 3/1986 | Oliff | 206/427 |
| 4,679,725 | 7/1987 | Wilson | 229/117.13 |

FOREIGN PATENT DOCUMENTS

| | | | |
|---|---|---|---|
| 2206564 | 1/1989 | United Kingdom | 229/117.13 |

*Primary Examiner*—Gary E. Elkins

[57] ABSTRACT

A carrier containing a plurality of layers of articles arranged in stacked end-to-end fashion. The carrier is fully enclosed and includes side end panel flaps which extend substantially the entire distance from the top panel to the bottom panel of the carrier to strengthen the carrier and prevent bowing of the panels. Score lines in the side end panel flaps further prevent bowing during folding. The top panel is formed by overlapping top panel flaps, the inner top panel flap including a folded-under reinforcing flap which produces an area of triple thickness between handle openings in the flaps and which extends into the end panels for additional reinforcement purposes.

18 Claims, 3 Drawing Sheets

CARRIER FOR STACKED ARTICLES

FIELD OF THE INVENTION

This invention relates to carriers which are adapted to contain a plurality of articles. More particularly, it relates to a carrier which is adapted to carry a plurality of layers of articles in stacked end-to-end relationship.

BACKGROUND OF THE INVENTION

Sleeve-type carriers are commonly used to package beverage cans and other types of articles, and are typically formed from paperboard blanks which have been folded into collapsed sleeve form. Each collapsed sleeve is opened by a packaging machine, and cans or other articles are introduced through one or both of the open ends of the sleeve, after which the end panel flaps are folded and secured together. The cans are normally introduced in upright position while the carrier sleeve is supported on one of its side panels, with the open ends of the sleeve facing out, transverse to the direction of movement of the sleeves through the machine, to receive the cans. The resulting carrier contains a layer of cans the ends of which are located adjacent the side panels of the carrier. Additionally, a handle is normally incorporated into the top panel of the carrier to facilitate lifting and carrying.

Although such carriers have been designed to contain varying numbers of articles, typical beverage can packages hold only six or twelve cans. This is partly because a conventional sleeve-type carrier would be quite long if its length were increased to accommodate large numbers of cans, and would be unwieldy to carry. Further, the heavier load caused by the additional cans would tend to promote tearing, particularly in the handle area.

One way to overcome some of the problems associated with packaging large numbers of cans in a carrier is to package them in stacked layers. This would make the package more compact and would not increase its size to the point where it could not be readily handled. For example, if twenty-four standard 12-fluid ounce cans are packaged in a carrier in two layers containing twelve cans each, with each layer being four can diameters long and three can diameters wide, the length of the carrier is the same as the length of a conventional single layer package of twelve cans, the height is only about two inches greater and the width is somewhat less than three inches greater. Yet the package provides twice the carrying capacity of the single layer conventional carrier. Further, additional layers of cans or other articles could be packaged by making the height of the carrier an additional article length greater.

Although cans and other articles have long been packaged in double layers in shipping cartons, the problems involved in packaging layers of articles in a sleeve-type carrier are not present in a double-layer shipping carton. Articles are normally loaded from the top in a shipping carton, and a handle is not normally provided in the top panel to enable the carrier to be lifted by one hand. The heavier loads caused by two layers of articles in a sleeve-type carrier require a carrier construction that can resist the lifting and carrying stresses, particularly in the handle area. Also, the greater height of the side and end panels of the carrier tends to exaggerate any tendency of the panels to be skewed in relation to adjacent panels, making it difficult to maintain the carrier in square condition in the packaging machine at the time the carrier panels are glued together. Further, when carriers are stacked for storage or shipping, the lower carriers receive quite large compressive loadings which tend to distort the carriers if provisions are not made to withstand them.

Since it would be highly advantageous to have available a sleeve-type carrier capable of holding layers of stacked articles, it is an object of the invention to provide a carrier of this type which overcomes the problems discussed.

BRIEF SUMMARY OF THE INVENTION

The carrier of the invention is designed to receive a plurality of layers of stacked articles, with the ends of the articles in the end layers being adjacent the top and bottom panels of the carrier. The carrier comprises two side panels connected to top and bottom panels, and end panels comprised of adhered flaps connected to the top, bottom and side panels. The flaps connected to the side panels include upper and lower edges which are substantially in contact with and parallel to the interior surfaces of the top and bottom panels so that the side end panel flaps extend substantially the entire distance from the top panel to the bottom panel. This serves to prevent bowing and skewing of the side end panel flaps, thereby maintaining the carrier in square condition prior to gluing the end panel flaps together. It also increases the ability of the carrier to withstand compressive loads received from stacking and handling.

The top panel of the carrier is comprised of an inner flap connected to one of the side panels along a fold line and an overlapping outer flap connected to the other side panel along a fold line, each top panel flap including a handle opening arranged so that the top panel contains spaced handle openings with a handle strap between them. The inner top panel flap is in face-to-face contact with a foldably connected reinforcing flap which contains a cutout aligned with the handle opening in the inner top panel flap. The upper end panel flaps are connected to the inner and outer top panel flaps by fold lines, overlapping in the same manner as the top panel flaps, with the reinforcing flap extending into the area of the end panel flaps. This arrangement further reinforces the end panels to strengthen them to help overcome the inherent weakness of the unusually tall side end panel flaps.

In another aspect of the invention, the upper end flap fold lines include slits in the overlapped areas of the upper end panel flaps to facilitate folding of these flaps, and the reinforcing flap includes score lines aligned with the slitted portions of the upper end flap fold lines to prevent tearing in these areas.

In another aspect of the invention, the side end panel flaps include a plurality of spaced score lines for resisting bowing of the flaps when folded about their fold lines.

The carrier may also include weakened tear-away sections in the top panel flaps and the connected upper end panel flaps for opening the carrier. Further, the side end panel flaps include spaced edges in the portions overlapped by the upper end panel flaps, whereby a coupon attached to a bottom end panel flap is visible and accessible when an overlying tear-away portion is removed.

Due to the stacked arrangement of the articles in the carrier, the carrier is of a shape and size which makes lifting by means of the handle a relatively simple task, even though the contents of the carrier may be quite heavy.

These and other features and aspects of the invention, as well as other benefits, will readily be ascertained from the detailed description of the preferred embodiment described below.

DETAILED DESCRIPTION OF THE PREFERRED EMBODIMENT

Figure 1:
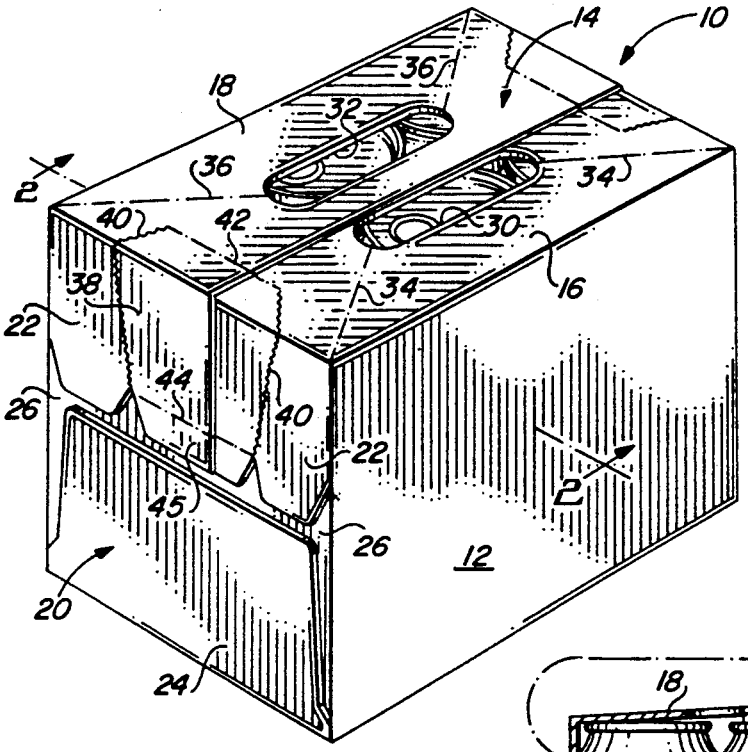
FIG. 1 is a pictorial view of the carrier of the invention.

Referring to FIG. 1 of the drawing, the carrier 10 is comprised of side panels 12 foldably connected to top panel 14 and to a bottom panel, not visible in this view. The top panel is comprised of two top panel flaps 16 and 18, described more fully below. End panels 20 are connected to the top, bottom and side panels and are comprised of upper end panel flaps 22 connected to the top panel flaps and lower end panel flaps 24 connected to the bottom panel. The end panel flaps are adhered to side end panel flaps or dust flaps 26, which are foldably connected to the side panels. Spaced handle openings 30 and 32 in the top panel extend along the length of the carrier substantially parallel to the side panels, and stress distribution score lines 34 and 36 extend from the ends of handle openings 30 and 32, respectively, to the corners of the carrier. In addition, the carrier includes a tear-away section 38 at each end formed by tear lines 40 in the upper end panel flaps 22 and the top panel flaps 16 and 18. The tear lines are connected in the top panel by fold line 42 and in the side panels by fold lines 44, the latter forming tabs 45 to be grasped by a user when removing the tear-away sections.

Figure 2:
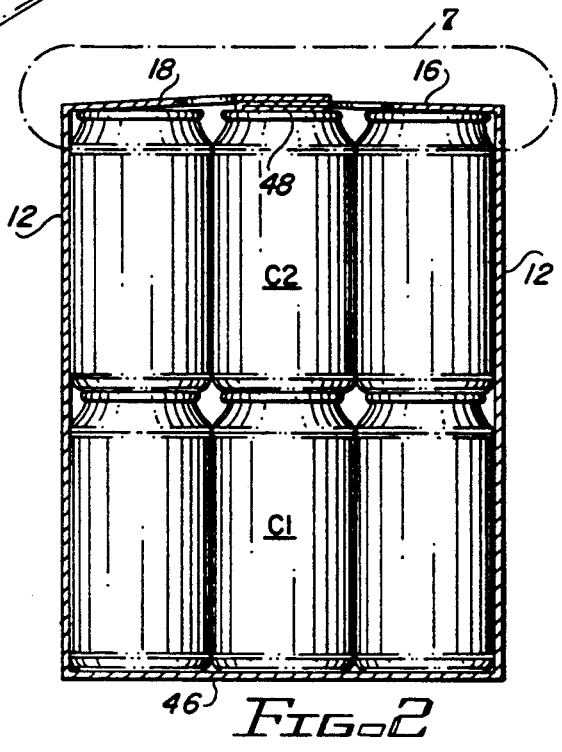
FIG. 2 is a vertical sectional view taken along line 2—2 of FIG. 1.
Figure 3:
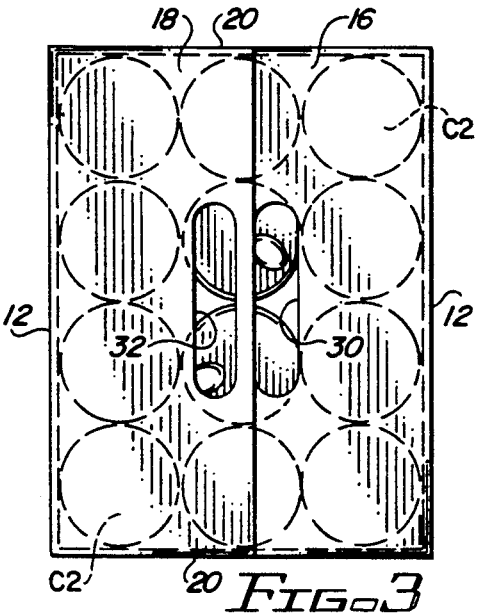
FIG. 3 is a plan view of the carrier of FIG. 1, illustrating the arrangement of the packaged cans.

As shown in FIGS. 2 and 3, the carrier contains a bottom layer of articles, shown for purpose of illustration as beverage cans C1, and an upper layer of articles, shown as cans C2, in stacked relationship. The lower ends of the upper cans C2 thus are supported on the upper ends of the bottom cans C1, with the bottom cans resting on the bottom panel 46. The top panel 14 is closely adjacent, and preferably is in contact with, the tops of the cans C2 to provide for a tight fit between the cans and the carrier. As shown in FIG. 3, the top layer of cans is made up of twelve cans arranged in three rows of four cans. Since the bottom layer is identically arranged, the total number of cans in the carrier is twenty-four. As illustrated in FIG. 2, the top panel is reinforced between the handle openings in the area designated by numeral 48, the details of which are explained hereinafter.

Figure 4:
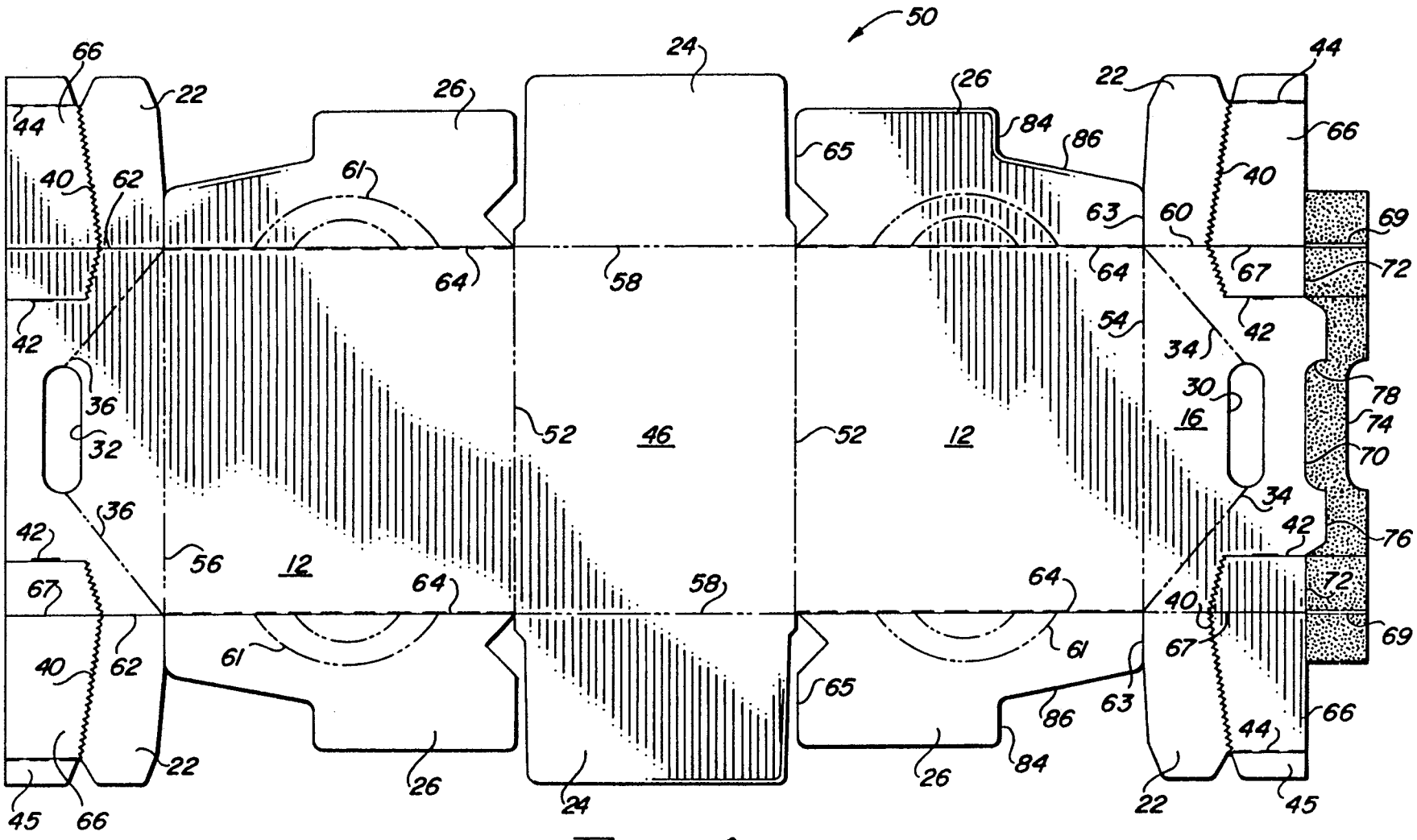
FIG. 4 is a plan view of a blank for fabricating the carrier of FIG. 1.

Referring now to FIG. 4, the carrier is formed from the blank 50, wherein portions corresponding to similar elements of the carrier are identified by the same reference numerals. The blank is a single sheet of material, preferably paperboard, comprising a centrally located bottom panel section 46 connected to the side panel sections 12 along fold lines 52. The inner top panel flap 16 is connected to one of the side panel sections 12 along fold line 54, while the outer top panel flap 18 is connected to the other side panel section 12 along fold line 56. The lower end panel flaps 24 are connected to the bottom panel section 46 along fold lines 58, and the upper end panel flaps 22 are connected to the inner and outer top panel flaps 16 and 18 along fold lines 60 and 62, respectively. Connected to the side panel sections 12 along fold lines 64 are the side end panel flaps or dust flaps 26, which contain arcuate score lines 61 terminating at the fold lines 64. The fold lines 58, 60, 62 and 64 are all aligned. Also aligned are the upper edges 63 of the dust flaps 26 with the fold line 54, and the lower edges 65 of the dust flaps with the fold line 52.

Each upper end panel flap 22 includes half sections 66 of the tear-away sections 38, the edges of which are adapted to overlap in a carrier formed from the blank. In addition, the inner top panel flap 16 includes reinforcing flap 68 which is connected to it along aligned fold lines 70 and 72. Preferably, the portions of the fold lines 60 in the half tear-away sections 66 include slits 67, and the portions of the fold lines 60 in the handle reinforcing flap 68 include a double score line 69. The outer edge of the reinforcing flap includes a half handle cutout 74, the length of which is equal and parallel to the fold line 70. Slits 76, which are located between the fold lines 70 and 72, separate the reinforcing flap from the inner top panel flap 16 and include arcuate portions 78 of similar shape to the arcuate portions of the handle cutout 74.

Figure 5:
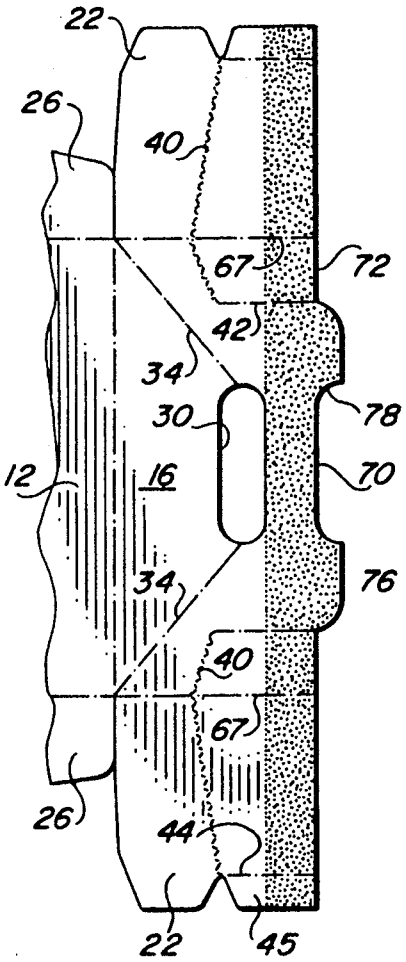
FIG. 5 is a partial plan view of an end portion of the blank after an initial folding step.

Fabrication of the carrier is carried out in conventional manner after first folding the reinforcing flap 68 under the inner top panel flap 16 so that the half handle cutout 74 is aligned with the outer half of the handle opening 30 and the score lines 69 are directly beneath the slits 67 in the fold line 60. The reinforcing flap 68 is glued in the stippled area of FIG. 4 to adhere it to the inner top panel flap 16. The blank is then folded along the fold lines 52, 54 and 56 to bring the top panel flaps 16 and 18 together in overlapping relationship, with glue having been applied in the stippled area of FIG. 5 so that the overlapped portions of the top panel flaps are adhered together. The upper end panel flaps 22 extending from the inner top panel flap 16 are thus adhered to the upper end panel flaps 22 extending from the outer top panel flap 18 to form the upper end panel flaps extending from the top panel. At this point, the dust flaps and the upper and lower end panel flaps of the resulting carrier sleeve are conventionally folded out of the loading path of the cans to be packaged to form the interim carrier sleeve configuration illustrated in FIG. 6. After the cans are loaded, the end panels of the finished carrier of FIG. 1 are formed in the usual manner by first folding in the dust flaps 26, then folding and gluing the upper and lower end panel flaps 22 and 24 against the dust flaps.

Figure 7:
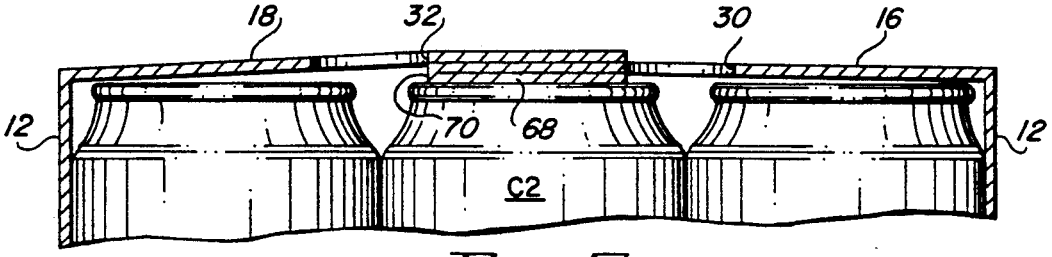
FIG. 7 is a transverse sectional view of the portion of the carrier enclosed by the oval 7 in FIG. 2.

As shown in FIG. 7, the handle strap between the handle openings 30 and 32 is comprised of three plies of material comprised of the reinforcement flap 68, the inner top panel flap 16 and the outer top panel flap 18. This adequately reinforces the handle area to protect it against tearing under the stresses of lifting and carrying. For purpose of illustration the thickness of the carrier material has been exaggerated. It will be understood, therefore, that in actual practice the thickness of the strap portion of the handle between the openings 30 and 32 will not be as great with respect to the height of the cans as shown, and the top panel flaps 16 and 18 will be in contact with more, if not all, of the top surface of adjacent cans.

As will be appreciated, there is little room for the fingers of a user to maneuver when trying to get a grip on the handle strap due to the close proximity of the tops of the cans to the top panel. The design of the invention anticipates upward movement of the top panel as the fingers pull up on the handle while first gripping the strap portion and during lifting and carrying. The top panel is adapted to smoothly bow upwardly without tearing at critical areas which normally receive most of the lifting stresses. This is accomplished by the stress relief score lines 34 and 36 which extend from the ends of the handle cutouts to the side panels. Preferably, as illustrated, these lines extend to the corners of the package, thereby transmitting the lifting stresses to the corner folds.

Figure 6:
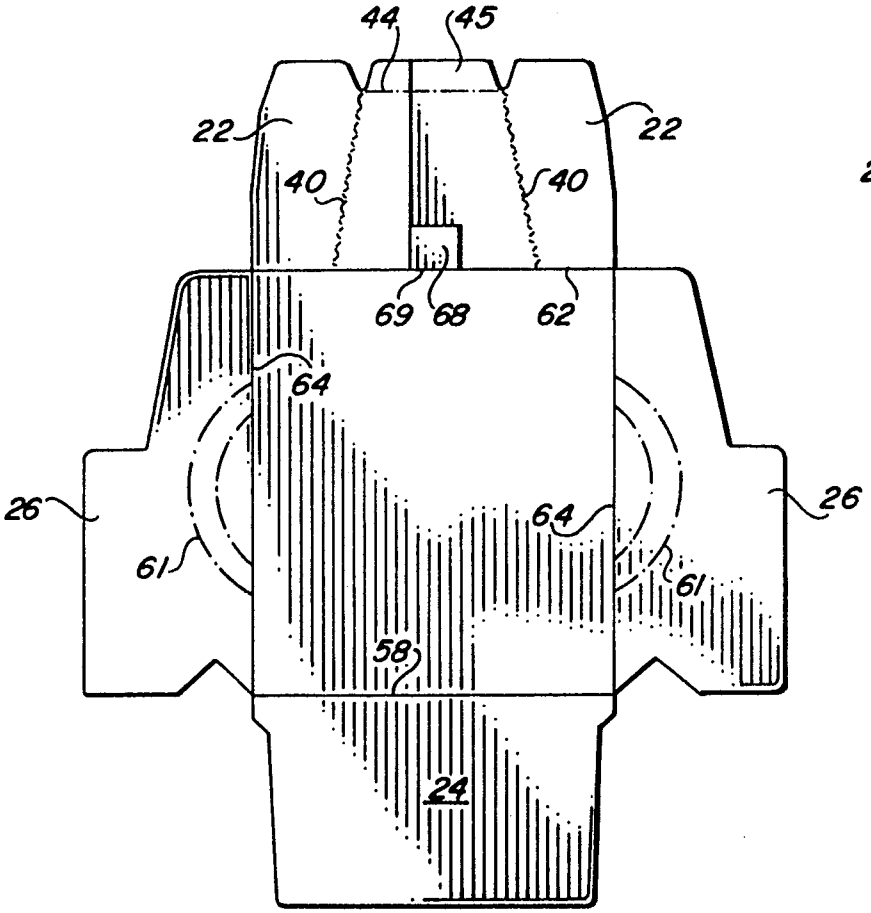
FIG. 6 is an end view of the carrier sleeve prior to loading.

The reinforcement flap 68 not only provides reinforcement in the handle area, but in the end panels as well. The reinforcement flap 68 includes end flaps 69 extending beyond the double score lines 69, which as shown in FIG. 6, provides a triple layer of paperboard in the upper central portion of the end panels. While the slits 67 in the fold line 60 facilitate folding of the overlapped portions of the upper end panel flaps when they are pivoted up to make room for the cans to be loaded through the open ends of the carrier sleeve, they would normally tend to cause the fold line 60 to tear in this area. The double score line 69 underlies the slits 67 of the fold lines 60, reinforcing and preventing tearing in this area.

Figure 8:
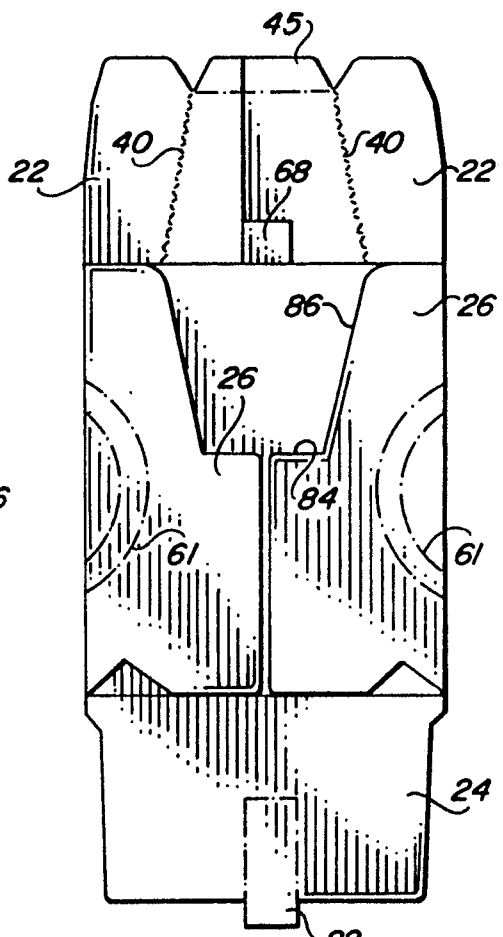
FIG. 8 is an end view of the carrier sleeve after the side end panel flaps have been folded into place.

Referring to FIG. 8, which illustrates the end of the carrier with the dust flaps in their final closed position, but before the upper and lower end flaps have been folded into place, it can be seen that the upper edges 63 of the dust flaps 26 are substantially parallel to and in contact with the top panel 14, while their lower edges 65 are substantially parallel to and in contact with the bottom panel 46. This is a result of the upper and lower edges 63 and 65 being aligned with the fold lines 54 and 52, respectively, as shown in FIG. 4. The dust flaps thus have a height substantially equal to the height of the end panels, extending directly from the top panel to the bottom panel, thereby being able to transmit compressive stresses caused by stacking and handling operations directly from the top panel to the bottom panel. This configuration also prevents the dust flaps from bowing when folded into place after the carrier sleeve has been loaded, and resists stresses during this phase of the packaging which would normally tend to push the carrier out of square. As noted earlier, the extra height of the carrier which permits it to hold stacked layers of cans would otherwise tend to be forced into skewed position. The bottom edge of the dust flaps may contain cutouts, as illustrated, if necessary to provide clearance for rails or other elements of the packaging machine, as long as a substantial length of the edge is in contact with the bottom panel.

The arcuate score lines 61 in the dust flaps further strengthen the dust flaps so as to resist bowing when the side panels are bowed outward. Although the score lines are illustrated as being arcuate, they may take any desired form, such as a series of spaced straight parallel lines, as long as they function to encourage folding along the fold lines 64 and to resist warping or bowing of the dust flaps during folding.

In summary, the invention provides a carrier which can be carried by a handle in the top panel and yet is capable of holding large numbers of cans or other articles. This is made possible by incorporating two layers of stacked articles in the carrier. The invention overcomes the tendency of the taller panels of the carrier to bow or become skewed out of square by employing side end panel flaps or dust flaps which extend substantially completely the entire distance from the top panel to the bottom panel. Bowing of the end panels is further resisted by score lines in the dust flaps. The end panels are further reinforced by the end portions of the handle reinforcement flap, which fold down into the end panels. The score lines connecting the end portions of the handle reinforcement flap to the main reinforcement flap body are aligned with the fold line slits of the upper end flaps to prevent breakout or tearing of these fold lines when the flaps are folded up prior to loading.

In addition, the configuration of the end panel flaps makes it possible to incorporate customer coupons in the carrier in a manner that permits the coupons to be visible and readily removed. As shown in FIG. 8, a coupon 82, shown in broken lines, may be adhered to the inner face of the lower end flap 24 so that when the lower end flap is folded up and adhered to the dust flaps 26, the coupon will extend above the shoulder 84 of the flaps between the upper side edges 86. The coupon is thus framed in the opening created by these edges prior to being covered by the upper end panel flaps 22. When the tear-away sections 66 are removed, the coupon is exposed. This overcomes the problem of where and how to locate a coupon so that it will be readily seen by a customer and not be inadvertently destroyed when the carrier is opened. It will be appreciated that the opening cannot be so large as to shorten the upper edges of the side end panels to the point where there is insufficient contact between the upper edge of the side end panel and the top panel of the carrier to enable compressive loads to be transmitted to the bottom panel.

Although a specific carrier design has been disclosed which is economical to fabricate, capable of increasing the carrying capacity over prior art carriers while only slightly increasing the carrier size, and preventing skewing or bowing of the end panels, it will be understood that changes to certain features and aspects of the design which do not affect the overall basic function and concept of the invention may be made by those skilled in the art without departing from the spirit and scope of the invention, as defined by the appended claims.

What is claimed is:

1. An article carrier containing a plurality of layers of stacked articles, comprising:

two side panels having upper and lower edges;

a bottom panel connected to the lower edges of the side panels said bottom panel having an interior and an exterior surface;

a top panel connected to the top edges of the side panels said top panel having an interior and an exterior surface;

end panels comprised of adhered flaps connected at the top, bottom and side panels, the flaps connected to the side panels including upper and lower edges which are substantially in contact with and parallel to the interior surfaces of the top and bottom panels so that the side end panel flaps extend substantially the entire distance from the top panel to the bottom panel; and the plurality of layers of articles having top and bottom ends, the articles of each layer being arranged in stacked end-to-end relationship with the articles in a next adjacent of said layers, the bottom ends of the articles in a lowermost layer of said plurality of layers being adjacent the bottom panel of the carrier and the top ends of the articles in an uppermost layer of said plurality of layers being adjacent the top panel of the carrier when the carrier is resting on the bottom panel.

2. The article carrier of claim 1, wherein the top panel is comprised of an inner flap connected to the upper edge of one of the side panels along a fold line and an overlapping outer flap connected to the upper edge of the other side panel along a fold line, and wherein the top panel includes a reinforced handle.

3. The article carrier of claim 2, wherein the inner and outer top panel flaps include as part of said reinforced handle, spaced handle openings providing a handle strap therebetween, the inner top panel flap having a reinforcing flap foldably connected thereto in face-to-face contact with the interior surface of the inner top panel flap, the reinforcing flap having a cutout aligned with the handle opening in the inner top panel flap.

4. The article carrier of claim 3, wherein the end panel flaps connected to the top panel are comprised of upper end panel flaps connected to each of the inner and outer top panel flaps by fold lines, the upper end panel flaps connected to the outer top panel flap overlapping the upper end panel flaps connected to the inner top panel flap, and the reinforcing flap extending onto the inner top panel flaps.

5. The article carrier of claim 4, wherein the upper end flap fold lines include slits in areas of the overlap of the upper end panel flaps.

6. The article carrier of claim 5, wherein the reinforcing flap includes score lines aligned with the slits in the upper end flap fold lines.

7. The article carrier of claim 1, wherein the side end panel flaps are connected to the side panels along fold lines and wherein said side end panel flaps include a plurality of spaced score lines for resisting bowing of said side end panel flaps when said side end panel flaps are folded about their fold lines.

8. The article carrier of claim 7, wherein at least some of the spaced score lines terminate at the fold lines connecting the side end panel flaps to the side panels.

9. The article carrier of claim 8, wherein the spaced score lines are comprised of arcuate fold lines having ends which terminate at the fold lines connecting the side end panel flaps to the side panels.

10. The article carrier of claim 1, wherein the top panel is comprised of an inner flap connected to the upper edge of one of the side panels along a fold line and an overlapping outer flap connected to the upper edge of the other side panel along a fold line, the inner and outer flaps including overlapping tear-away portions for providing access to the layers of stacked articles contained in the carrier.

11. The article carrier of claim 10, wherein the upper and lower end panel flaps overlie and are adhered to the side end panel flaps, the side end panel flaps including spaced edges defining an opening which is overlapped by the upper end panel flaps, whereby a coupon attached to a bottom end panel flap is visible and accessible when an overlying tear-away portion is removed.

12. An article carrier containing a plurality of layers of stacked articles, comprising:

two side panels having upper and lower edges;

a bottom panel connected to the lower edges of the side panels said bottom panel having an interior and an exterior surface;

a top panel connected to the top edges of the side panels said top panel having an interior and an exterior surface;

end panels comprised of adhered flaps connected to the top, bottom and side panels, the flaps connected to the side panels including upper and lower edges which are substantially in contact with and parallel to the inner surfaces of the top and bottom panels so that the side and panel flaps extend substantially the entire distance from the top panel to the bottom panel;

the side end panel flaps being connected to the side panels along fold lines and said side end panel flaps including a plurality of spaced score lines for resisting bowing of said side end panel flaps when said flaps are folded about their fold lines;

the top panel being comprised of an inner flap connected to the upper edge of one of the side panels along a fold line and an overlapping outer flap connected to the upper edge of the other side panel along a fold line, the end panel flaps connected to the top panel being comprised of end panel flaps connected to each of the inner and outer top panel flaps by fold lines, the end panel flaps connected to the outer top panel flap overlapping the end panel flaps connected to the inner top panel flap.

13. A blank for forming an article carrier adapted to contain a plurality of layers of stacked articles, comprising:

a bottom panel section connected at opposite edges along fold lines to side panel sections;

an outer top panel flap connected to one of the side panel sections along a fold line and an inner top panel flap connected to the other side panel section along a fold line;

lower end panel flaps connected to the bottom panel section along fold lines;

upper end panel flaps connected to the top panel flaps along fold lines;

the inner and outer top panel flaps are adapted to be overlapped in the carrier formed from the blank, and wherein each said top panel flap includes a handle opening adapted to be spaced from each other in the carrier to provide a handle strap therebetween, the inner top panel flap having a reinforcing flap foldably connected thereto and adapted to be in face-to-face contact with an interior surface of the inner top panel flap int eh carrier formed from the blank, said reinforcing flap extending beyond the fold lines connecting the top panel flaps to the upper end panel flaps so as to reinforce the upper end panel flaps;

side end panel flaps connected to the side panel sections along fold lines, the end panel flaps at each side of the blank adapted to be adhered together to form end panels of the carrier; and the side end panel flaps including upper and lower edges extending away from the side panel sections, said upper edges of said side end panel flaps being substantially aligned with the fold lines connecting the side panel sections to the top panels flaps and said lower edges being substantially aligned with the fold lines connecting the side panel sections to the bottom panel section.

14. The carrier blank of claim 13, wherein the upper end panel flaps are adapted to be overlapped in a carrier formed from the blank, the fold lines connecting the upper end panel flaps to the inner and outer top panel flaps including slits in the of the overlap areas of the upper end panel flaps.

15. The carrier blank of claim 14, wherein the reinforcing flap includes score lines aligned with the slits in the upper end flap fold lines.

16. The carrier blank of claim 13, wherein the side end panel flaps include a plurality of spaced score lines for resisting bowing of said flaps when said side end panel flaps are folded about their fold lines.

17. The carrier blank of claim 16, wherein at least some of the spaced score lines terminate at the fold lines connecting the side end panel flaps to the side panel sections.

18. The carrier blank of claim 17, wherein the spaced score lines are comprised of arcuate fold lines having ends of which terminate at the fold lines connecting the side end panel flaps to the side panel sections.

* * * * *